US008021498B2

(12) United States Patent
Ogawa et al.

(10) Patent No.: US 8,021,498 B2
(45) **Date of Patent: *Sep. 20, 2011**

(54) MAGNETIC CORE AND APPLIED PRODUCT MAKING USE OF THE SAME

(75) Inventors: Yuichi Ogawa, Kumagaya (JP); Masamu Naoe, Kumagaya (JP); Yoshihito Yoshizawa, Fukaya (JP)

(73) Assignee: Hitachi Metals, Ltd., Tokyo (JP)

( * ) Notice: Subject to any disclaimer, the term of this patent is extended or adjusted under 35 U.S.C. 154(b) by 836 days.

This patent is subject to a terminal disclaimer.

(21) Appl. No.: 11/909,951

(22) PCT Filed: Mar. 28, 2006

(86) PCT No.: PCT/JP2006/306304

§ 371 (c)(1), (2), (4) Date: Nov. 6, 2007

(87) PCT Pub. No.: WO2006/104148

PCT Pub. Date: Oct. 5, 2006

(65) Prior Publication Data

US 2009/0145524 A1 Jun. 11, 2009

(30) Foreign Application Priority Data

Mar. 29, 2005 (JP) ..... 2005-094877
Mar. 9, 2006 (JP) ..... 2006-063540

(51) Int. Cl.
*H01F 1/153* (2006.01)

(52) U.S. Cl. ..... 148/304; 148/403

(58) Field of Classification Search ..... None
See application file for complete search history.

(56) References Cited

U.S. PATENT DOCUMENTS 6,060,172 A * 5/2000 Inoue et al. ..... 428/551
6,416,879 B1 * 7/2002 Sakamoto et al. ..... 428/606

FOREIGN PATENT DOCUMENTS

JP 59-150415 A 8/1984
JP 05-140703 A 6/1993
JP 10-323742 A 12/1998
JP 2002-285304 A 3/2002
JP 2005-256104 A 9/2005

* cited by examiner

*Primary Examiner* — John P Sheehan
(74) *Attorney, Agent, or Firm* — Sughrue Mion, PLLC

(57) ABSTRACT

A magnetic core making use of an Fe-based amorphous alloy ribbon that simultaneously attains miniaturization and noise reduction through realization of high $B_s$; and an applied product making use of the same. There is provided a magnetic core making use of an Fe-based amorphous alloy ribbon, wherein the saturated magnetic flux density ($B_s$) of the Fe-based amorphous alloy ribbon is ≧1.60 T and wherein the ratio between magnetic flux density at a core external magnetic field of 80 A/m ($B_{80}$) and $B_s$ of the Fe-based amorphous alloy ribbon, $B_{80}/B_s$, is ≧0.90.

9 Claims, 3 Drawing Sheets

MAGNETIC CORE AND APPLIED PRODUCT MAKING USE OF THE SAME

TECHNICAL FIELD

The present invention relates to a magnetic core using an Fe-based amorphous alloy ribbon mainly for the purpose of reducing noise, and can be used for an applied product such as a motor, a transformer, a choke coil, a generator or a sensor.

BACKGROUND ART

An Fe-based amorphous alloy ribbon receives attention as a magnetic core material of a transformer, a motor, a choke coil, a sensor and the like, because of excellent soft magnetic properties, particularly a low core loss among them. It has been practically used for various magnetic cores, parts and apparatuses. Among the Fe-based amorphous alloy ribbons, an FeSiB-based amorphous alloy ribbon has been widely used in particular, because it shows comparatively a high saturated magnetic flux density $B_s$ and superior thermal stability. However, the FeSiB-based amorphous alloy ribbon has problems that the magnetic core becomes large because the FeSiB-based amorphous alloy ribbon has lower $B_s$ than a silicon steel sheet, and that the magnetic core generates a high level of noise. As a method for increasing $B_s$ in the Fe-based amorphous alloy ribbon, there have been practically carried out methods of: increasing an amount of Fe which bears magnetism; inhibiting thermal stability from deteriorating due to increased amount of Fe by adding Sn, S or the like; adding C; or adding C and P. JP-A-05-140703 discloses a method of increasing $B_s$ by employing a composition of FeSiBCSn, enhancing the formability of amorphous in an Fe-rich area by adding Sn. On the other hand, JP-A-2002-285304 discloses a method of increasing $B_s$ by employing a composition of FeSiBCP, greatly increasing the Fe content specifically by adding P into a limited composition range of Fe, Si, B and C. Regarding reducing magnetostriction, which is necessary for reducing a noise level, the saturation magnetostriction of the Fe-based amorphous alloy ribbon is approximately proportional to the square of $B_s$. Accordingly, the Fe-based amorphous alloy ribbon having high $B_s$ and low magnetostriction has not been realized yet. For this reason, an amorphous or a nano-crystalline alloy ribbon with low $B_s$ and low magnetostriction has been used for the magnetic core and an applied product with the use of the magnetic core, which is required not to cause a problem of noise.

[Patent Document 1]

JP-A-05-140703 ((0008) to (0010), and FIG. 1)

[Patent Document 2]

JP-A-2002-285304 ((0010) to (0016), and Table 1)

DISCLOSURE OF THE INVENTION

Problem to be Solved

As described above, a magnetic core made from a conventional Fe-based amorphous alloy ribbon with high $B_s$ has high saturation magnetostriction and causes a high level of noise. In other words, there has not been such a magnetic core as to concurrently satisfy high $B_s$ and a low level of noise. For this reason, an object of the invention is to provide a magnetic core making use of an Fe-based amorphous alloy ribbon that simultaneously attains miniaturization and noise reduction through realization of high $B_s$, and an applied product making use of the same.

Means for Solving the Problem

In order to realize miniaturization through the realization of high $B_s$ and noise reduction, the causes of noise have been studied, and it is found that the squareness of an Fe-based amorphous alloy ribbon has a close relationship with the noise generated from a magnetic core made from the Fe-based amorphous alloy ribbon, and that the squareness is further improved by optimizing a composition of the alloy, a composition in the vicinity of the surface, and a segregation in the alloy, and by improving the surface condition. As a result, it is found that the magnetic core which generates an unprecedentedly low level of noise can be made from an Fe-based amorphous alloy ribbon, and the invention is accomplished.

A magnetic core according to the invention employs an Fe-based amorphous alloy ribbon characterized in that the ribbon has a saturated magnetic flux density $B_s$ of not lower than 1.60 T, and a ratio $B_{80}/B_s$ of not less than 0.90, which is the ratio of a magnetic flux density $B_{80}$ generated in an external magnetic field of 80 A/m applied to the magnetic core in relation to $B_s$.

The magnetic core made by using the Fe-based amorphous alloy ribbon having the adequate squareness shows the magnetic flux density of 1.4 T and a core loss $W_{14/50}$, at a frequency of 50 Hz, being not higher than 0.28 W/kg. Furthermore it can provide a product which generates such an unprecedentedly low level of noise as $20\times\log[(L^2\times10^{-9}+2\times10^{-5})/(2\times10^{-6})]$ dB or less when a magnetic flux density is 1.4 T, a frequency is 50 Hz and an average magnetic path length is L mm. The average magnetic path length "L" mm means a circumferential length at the middle of the thickness of the magnetic core. For instance, when the magnetic core has a perfectly circular shape and an average diameter ((outside diameter+inside diameter)/2) being R, the length L becomes $\pi R$ ($L=\pi R$). The above expression on the noise level shows a boundary in the form of an approximate expression, between the invention and comparative example, when a relationship between the average magnetic path length and the noise level of the invention and comparative example are measured.

The Fe-based amorphous alloy ribbon used in the magnetic core preferably employs such a material with high $B_s$ as to have a composition that is expressed by a formula $T_aSi_bB_cC_d$ (wherein T represents Fe, or Fe and at least one element of Co and Ni in an amount of not more than 10% with respect to Fe), in which the suffixes satisfy the expressions of, by atom %, $76\leqq a<84\%$, $0<b\leqq12\%$, $8\leqq c\leqq18\%$, and $0.01\leqq d\leqq3\%$, and that includes unavoidable impurities. The ribbon to be used has a thickness of 5 μm to 100 μm. When it has a thickness of not more than 5 μm, the Fe-based amorphous alloy ribbon is difficult to be manufactured, and cannot obtain uniform properties because the surface condition affects the properties much. When it has a thickness exceeding 100 μm, it tends to suffer from surface crystallization and deterioration of the properties.

The Fe-based amorphous alloy ribbon used in the magnetic core showing higher $B_s$ and high squareness preferably has a composition, in which, by atom %, an amount of Fe is $81\leqq a\leqq83$; an amount of Si is $0<b\leqq5$; an amount of B is $10\leqq c\leqq18$; and an amount of C is $0.2\leqq d\leqq3$. The alloy having this composition shows particularly high squareness in the previously described composition range. The ribbon having the above composition shows a ratio $B_{80}/B_s$ of not lower than 0.93, which is the ratio of a magnetic flux density $B_{80}$ generated in an external magnetic field of 80 A/m applied to the magnetic core in relation to $B_s$.

The reason for the above limitation to the composition will be described below. Hereinafter, the unit merely described as "%" represents atomic percent.

When an Fe content "a" is less than 76%, the amorphous alloy ribbon does not obtain sufficient $B_s$ for a core material and thus the size of a magnetic core is increased, which is unpreferable. When the Fe content "a" is not less than 84%, on the other hand, the amorphous alloy ribbon shows low thermal stability and cannot be stably manufactured. In order to obtain high $B_s$, the value "a" is preferably not less than 81% but not more than 83%. Not more than 10% of the Fe content can be replaced by at least one element of Co and Ni depending on required magnetic properties.

An element Si contributes to the capability of forming an alloy into amorphous. An Si content "b" is not more than 12% in order to increase $B_s$. It is preferably not more than 5% in order to obtain high $B_s$.

An B (boron) content "c" contributes most significantly to the capability of forming an alloy into amorphous. When the boron content "c" is less than 8%, the thermal stability of the amorphous alloy decreases, but even though the boron content "c" is more than 18%, the capability of forming amorphous is not improved any more. The boron content "c" is preferably not less than 10% in order to keep the thermal stability of the amorphous material having high $B_s$.

An element C (carbon) has an effect of improving squareness and $B_s$ of the material as to miniaturize a magnetic core and reduce noise. When a carbon content "d" is less than 0.01%, the effect is not shown. When it is more than 3%, the amorphous alloy becomes brittle and thermal stability is decreased so that it becomes difficult to be manufactured into a magnetic core, which is undesirable. In order to impart high $B_s$ and high squareness to the amorphous alloy, the carbon content "d" is preferably not less than 0.2%, and is further preferably not less than 0.5%.

When not more than 10% of an Fe content is replaced by one or two elements of Ni and Co, $B_s$ increases, which contributes to the miniaturization of a magnetic core. However, it is not practical for the amorphous alloy to contain more than 10% of the elements, because the raw materials of the elements are expensive. An element Mn shows an effect of increasing $B_s$ even when a slight amount is added. When not less than 0.50 at % of Mn is added, $B_s$ is decreased. Accordingly, an amount of Mn is preferably not less than 0.1% but not more than 0.3%.

In addition, the amorphous alloy may include one or more elements of Cr, Mo, Zr, Hf and Nb in an amount of 0.01 to 5%, and may include at least one element of S, P, Sn, Cu, Al and Ti in an amount of not more than 0.50% as an unavoidable impurity.

Means for improving squareness will be specifically described. FIG. 1 shows a relationship between a noise level and a value $B_{80}$ of a toroidal magnetic core having an average core diameter of 30 mm, at 1.4 T and 50 Hz. As the value of $B_{80}$ increases, the value of the magnetic flux density at which noise starts occurring (reaching or exceeding a background noise level) shifts to a higher magnetic flux density side. In order to increase the $B_{80}$ of the magnetic core, it is important to increase the $B_s$ of the ribbon and improve the squareness of the magnetic core. The squareness of the magnetic core can be improved by annealing the magnetic core in a magnetic field while controlling the annealing temperature and the annealing period of time. The magnetic field is a direct current magnetic field or an alternating current magnetic field, which has a strength of not lower than 200 A/m, and is applied to the magnetic core in parallel to a longitudinal direction of the ribbon (in a circumferential direction of magnetic core). The magnetic core is heated to 250 to 450° C. at an average heating rate of 0.3 to 600° C./min, and held at the temperature for not shorter than 0.05 hours. It is then cooled at an average cooling rate of 0.3 to 600° C./min. Preferably it is heated at the heating rate of 1 to 20° C./min, and is held 270 to 370° C. for not shorter than 0.5 hours. The atmosphere is preferably that of an inert gas such as $N_2$ and Ar, but may be the atmosphere of air. In addition, the same effect can be obtained by two-stage heat treatment or a long period of heat treatment at a low temperature of not higher than 250° C. When the magnetic core has a large size and a consequently large heat capacity, it may be heat-treated in a pattern of: temporarily holding the magnetic core at a lower temperature than the target holding temperature; then heating it to the target temperature; holding it at the temperature; and cooling it. Any of a direct current, an alternating current and a repeated pulse current magnetic field may be used for an applied magnetic field. The strength of the magnetic field to be applied on the magnetic core is sufficient only to make the core magnetically saturate, and is generally not lower than 80 A/m by an effective value. It is preferably not lower than 400 A/m and particularly preferably not lower than 800 A/m. The heat-treatment makes the magnetic core have a low noise. The heat-treatment is preferably performed in an atmosphere of an inert gas generally having a dew point of not higher than −30° C. The heat-treatment in an inert gas atmosphere having a dew point of not lower than −60° C. is further preferable, because more preferable effect is obtained due to less distribution.

In order to further improve squareness, it is preferable to employ an Fe-based amorphous alloy ribbon having a carbon segregation layer which shows a peak value in a 2 to 20 nm deep region from a free surface and/or a rolled surface. A magnetic core using the Fe-based amorphous alloy ribbon shows a ratio $B_{80}/B_s$ of not lower than 0.95, which is the ratio of a magnetic flux density $B_{80}$ in an external magnetic field of 80 A/m applied to the magnetic core in relation to a saturated magnetic flux density $B_s$ of the Fe-based amorphous alloy ribbon.

In general, carbon is not positively added, because the addition of carbon produces a carbon segregation layer on the surface of a ribbon, which causes an embrittlement and thermal instability of the ribbon, and increases a core loss at a high magnetic flux density. An influence of an added carbon and the behavior of carbon distribution on the surface have been examined, and it has found that an amorphous alloy can be obtained having high squareness, low brittleness and high thermal stability, by controlling a ratio of a carbon content to a Si content and a surface state as to control a position of the carbon segregation layer and a peak position of the segregation layer into a predetermined range. The formed carbon segregation layer causes structural relaxation in the vicinity of the surface at a low temperature, which has a great effect on stress relaxation. When a stress relaxation is high, high squareness is obtained and a noise level and a core loss in a high magnetic flux density region are reduced. It is important to position the carbon segregation layer at a predetermined portion and a peak value in a predetermined range in order to make the carbon segregation layer show the effect. When the surface of the amorphous alloy ribbon has a large roughness due to an air pocket or the like, the thickness of an oxide layer becomes non-uniform, and thereby the position and thickness in a depth direction of the carbon segregation layer become non-uniform. Thereby, the structural relaxation becomes non-uniform, and a partially brittle part is produced. In addition, since the unevenness of the surface decreases cooling rate thereof, a surface of the carbon segregation layer in the vicinity is promoted to crystallization and thus the squareness is decreased. Accordingly, it is important to control the surface roughness and form the peak position of the carbon segregation layer in a 2 to 20 nm uniformly deep region from the surface. As a method thereof, it is effective to blow a $CO_2$, He or Ar gas onto a roll during casting the alloy, or to blow CO gas to burn it for reducing. It was found that the surface roughness is greatly improved and the peak position of the carbon segregation layer can be controlled into the 2 to 20 nm deep position, by controlling oxygen concentration in the vicinity of an outlet of a nozzle tip into not more than about 10%. In order to control the oxygen concentration in atmospheric air to not more than about 10% at the outlet of the nozzle tip, it is effective to blow the gas onto a roll portion in the rear side of the outlet as shown in FIG. 2. If the gas directly hits on a paddle which is tapping out a molten alloy, the gas affects the shape of the paddle to cause the thickness of the alloy ribbon non-uniform, or produces unevenness on the surface of the alloy ribbon by being involved into the alloy ribbon to increase the surface roughness, which shifts the position of the carbon segregation layer to the inner part. The gas further occasionally causes edge defectiveness. For this reason, it is preferable to blow the sprayed gas onto the roll 2 so that the sprayed gas may not give influence on the paddle. It is preferable to cast the Fe-based amorphous alloy while adjusting an angle between a roll surface and a gas-blowing nozzle 6, a distance between the roll surface and the exhaust nozzle and a gas pressure so that the gas pressure in the vicinity of the roll surface at the exhaust nozzle can be not higher than 0.20 MPa and oxygen concentration at the exhaust nozzle can be not more than 10%. Thereby, the surface roughness can be controlled into not more than 0.60 μm and the peak position of the carbon segregation layer can be controlled into a region between 2 and 20 nm from the alloy ribbon surface. When the gas pressure in the vicinity of the roll surface at the exhaust nozzle is not lower than 0.20 MPa, the gas gives influence on the paddle to shift the peak position of the carbon segregation layer to the inner part than 20 nm. When the width of the amorphous alloy ribbon becomes large, the oxygen concentration tends to be distributed in a width direction, which makes the surface roughness uneven. Accordingly, it is important to adjust the oxygen concentration to not more than 10%, in the vicinity of edges at which the oxygen concentration tends to be high. Thus controlled oxygen concentration of not more than 10% at the exhaust nozzle drastically reduces the surface roughness, and makes the position and thickness of the carbon segregation layer approximately uniform. It improves a stress relaxation degree and the squareness, decreases the noise and core loss of a magnetic core using the Fe-based amorphous alloy ribbon and parts containing the magnetic core, and suppresses the surface crystallization and the embrittlement. Consequently, it can sufficiently derive the effect of added carbon.

The effect can be further enhanced by controlling the surface state and besides controlling an Si content to a certain level or lower with respect to a carbon content. Although depending on the carbon content, the effect can be enhanced by decreasing a value of b/d with respect to a fixed carbon content. FIG. 3 shows a relationship between the stress relaxation degree and a maximum distortion with respect to the carbon content and the Si content. As a result of having used 82 atom % of Fe ($Fe_{82}Si_xB_{18-x-y}C_y$), the alloy showed a stress relaxation degree of not less than 90% (region I) when the composition satisfied $b \leqq 5 \times d^{1/3}$. The reason is considered to be because a peak value of a carbon segregation layer increases by reducing the Si content for a fixed carbon content. In other words, the stress relaxation degree can be changed by controlling the peak value by changing the Si content with respect to the carbon content. When the carbon content "d" is not less than 3%, the amorphous alloy shows the maximum distortion of not more than 0.020 (region II) and causes a problem in thermal stability. The carbon content "d" controlled to be not more than 3% forms such a composition as to acquire a high stress relaxation degree and a high saturated magnetic flux density, and can improve squareness and reduce noise. It further suppresses embrittlement, surface crystallization and the degradation of the thermal stability which occur when a large amount of carbon are added.

An Fe-based amorphous alloy ribbon can be impregnated or coated as needed. It can be used as a wound and cut core or a multilayered core by impregnated in a resin, such as an epoxy resin, an acryl resin or a polyimide resin, or bonded to an alloy. The magnetic core is generally used after having been accommodated in a resin case or having been coated.

Advantages of the Invention

As described above, such a magnetic core can be obtained as to generate little noise, cause a low core loss, suppress embrittlement, and the degradation of thermal stability, by employing a material with high $B_s$ and increasing $B_{80}/B_s$. Furthermore, an alloy composition capable of effectively increasing $B_{80}/B_s$ are found, so that such a magnetic core can be provided as to have a value $B_{80}/B_s$ of not less than 0.93 and be further preferable for reducing noise. In addition, the magnetic core can be provided which has a value $B_{80}/B_s$ of not less than 0.95 and be further preferable for reducing noise, by using an amorphous alloy ribbon which has a controlled composition and surface state and a controlled position and peak value of a carbon segregation layer in a fixed range. By using such magnetic cores, an applied product can be provided which can generate little noise, cause a low core loss, suppress embrittlement, and the degradation of thermal stability.

BEST MODE FOR CARRYING OUT THE INVENTION

Next, the present invention will be specifically described with reference to examples, but the invention is not limited to the examples.

Example 1

An amorphous alloy ribbon having a thickness of 23 to 25 μm and a width of 5 mm was produced by the steps of: preparing 200 g of a mother alloy having a composition of $Fe_{82}Si_2B_{13.9}C_2Mn_{0.1}$; heating the mother alloy to 1300° C. with a high-frequency power to melt it and preparing the molten metal; and spouting the molten metal onto a Cu—Be alloy roll which is rotating at 25 to 30 m/s. A port for blowing $CO_2$ gas was installed at a position of 10 cm apart from an exhaust nozzle of a Cu roll in a rear direction so that the port for blowing $CO_2$ gas forms an angle of 45 degrees with respect to the roll surface. The amorphous alloy was cast while adjusting the blowing pressure of $CO_2$ gas and controlling the gas pressure in the vicinity of the roll at the exhaust nozzle to 0 (no gas blown), 0.1 and 0.3 MPa. Then, it was found that oxygen concentrations in the vicinity of the exhaust nozzle (within 3 cm apart from the place at which the molten metal contacts with the roll) were 20.5, 8.5 and 7.5% respectively. It was confirmed from a measurement result that the amorphous alloy ribbon manufactured with the gas pressure controlled to 0.1 MPa in the vicinity of the roll at the exhaust nozzle (8.5% oxygen in the vicinity of the exhaust nozzle) has a peak of a carbon segregation layer in a position of 2 to 20 nm deep from the surface. The amorphous alloy ribbon was slit into the width of 5 mm, and three toroidal magnetic cores were produced having inner diameter/outer diameter of, respectively, 20/25, 25/35 and 70/75 mm. Then, the properties were measured. The amorphous alloy ribbon had a width of 5 mm and a thickness of 23 to 25 μm. The magnetic cores were annealed. Specifically, they were heated to 300 to 370° C. at the heating rate of 5° C./min, held at the temperature for one hour, and then cooled in a furnace, while a magnetic field of 1500 A/m was applied to the magnetic core in a circumferential direction of the magnetic core in argon atmosphere. The properties were compared at the annealed temperature at which a core loss is least. The properties are shown in Table 1. $B_s$ was measured by using a vibrating sample magnetometer (VSM) in which a magnetic field of 5 kOe was applied to a single sheet sample. $B_{80}$, a core loss $W_{13/50}$ at 1.3 T by the frequency of 50 Hz, and a core loss $W_{14/50}$ at the magnetic flux density of 1.4 T by the frequency of 50 Hz were measured on the toroidal magnetic cores. A noise level was measured in an anechoic room at a background noise level of 12 to 14 dB under conditions of the magnetic flux density of 1.4 T by the frequency of 50 Hz. In the room, a microphone was set at a position of 10 cm apart from the toroidal magnetic core. A stress relaxation degree was determined by the steps of: winding the single sheet sample around a quartz ring; measuring the diameter in the initial stage (that is, the diameter of the sample when being wound around the quartz ring), defining the value as $R_0$; annealing the single sheet sample wound around the quartz ring; measuring the diameter of the sample after having been removed from the quartz ring, defining the value as R; and calculating the value of $R_0/R\times100$ from the measured values. The surface roughness of the rolled surface was 0.30 to 0.50 μm. All samples showed $B_{80}/B_s$, which means squareness, were not less than 0.95. It was confirmed that the magnetic cores showed lower values of the noise level than $20\times\log[L^2\times10^{-9}+2\times10^{-5}]/(2\times10^{-6})]$ dB which is specified in the invention.

TABLE 1

| | sample No | Magnetic path length (mm) | $B_{80}$(T) | Bs(T) | $B_{80}/B_S\times100$(%) | Stress relaxation degree (%) | $W_{13/50}$ (W/kg) | $W_{14/50}$ (W/kg) | Noise level (dB) |
|---|---|---|---|---|---|---|---|---|---|
| Example 1 | 1 | 70.7 | 1.59 | 1.67 | 95.3 | 95 | 0.15 | 0.23 | 18 |
| Example 1 | 2 | 94.2 | 1.60 | 1.67 | 95.9 | 95 | 0.15 | 0.21 | 17 |
| Example 1 | 3 | 227.7 | 1.61 | 1.67 | 96.5 | 95 | 0.15 | 0.21 | 25 |
| Example 1 | 4 | 345.4 | 1.62 | 1.67 | 97.1 | 95 | 0.15 | 0.20 | 29 |
| Example 1 | 5 | 628.0 | 1.59 | 1.67 | 95.3 | 95 | 0.16 | 0.24 | 33 |

Comparative Example 1

Samples were produced so that each sample can acquire different $B_{80}/B_s$ in a range of less than 0.90 by annealing magnetic cores in a non magnetic field at 320° C., in a non magnetic field at 250° C., and in a magnetic field applied in a direction perpendicular to a circumferential direction (axial direction of magnetic core) at 320° C., on conditions similar to the case of Example 1. The properties are shown in Table 2. A noise level increased from a low magnetic flux density region, and increased to 24 dB, 28 dB and 35 dB along with the decrease of $B_{80}/B_s$, at 1.4 T. All samples showed that $B_{80}/B_s$, which means squareness, was less than 0.90. It was confirmed that the magnetic cores showed higher values of the noise level than $20\times\log[(L^2\times10^{-9}+2\times10^{-5})/(2\times10^{-6})]$ dB which is specified in the invention.

TABLE 2

| | Sample No | Magnetic path length (mm) | $B_{80}$(T) | Bs(T) | $B_{80}/B_S\times100$(%) | Stress relaxation degree (%) | $W_{13/50}$ (W/kg) | $W_{14/50}$ (W/kg) | Noise level (dB) |
|---|---|---|---|---|---|---|---|---|---|
| Comparative Example 1 | 6 | 94.2 | 1.45 | 1.67 | 86.9 | 95 | 0.21 | 0.32 | 24 |
| Comparative Example 1 | 7 | 94.2 | 1.33 | 1.67 | 79.7 | 95 | 0.28 | 0.39 | 28 |
| Comparative Example 1 | 8 | 94.2 | 1.00 | 1.67 | 59.9 | 95 | 0.26 | 0.35 | 35 |
| Comparative Example 1 | 9 | 227.7 | 1.46 | 1.67 | 87.5 | 95 | 0.20 | 0.33 | 33 |
| Comparative Example 1 | 10 | 345.4 | 1.48 | 1.67 | 88.7 | 95 | 0.21 | 0.35 | 39 |

Example 2

Amorphous alloy ribbons having a width of 5 mm was produced by preparing 200 g of a mother alloy having compositions shown in Table 3, and then by similar steps to the case of Example 1, and the properties were measured on a toroidal magnetic core with an inner diameter/outer diameter of 25/35 mm. The properties are shown in Table 3. A position of a carbon segregation layer was measured by quantitatively analyzing elements from the rolled surface in a depth direction by using GD-OES (glow discharge optical emission spectrometer) made by Horiba, Ltd. In the result, a portion having a higher carbon concentration than the uniform concentration in the inner part was regarded as the carbon segregation layer, and the position at which the concentration is highest and the concentration value were read out as the position of the carbon segregation layer and the value of the carbon peak. It is understood that a noise level has highly relevant to $B_{80}$, that noise can be reduced by enhancing $B_s$ and a squareness ratio, and further that a carbon addition is effective in enhancing the squareness and reducing noise.

TABLE 3

| Sample No | Composition (at %) | $B_{80}$ (T) | $B_S$ (T) | $B_{80}/B_S$ (T) | Stress relaxation degree (%) | Peak position of C segregation layer (nm) | Value of C peak (at %) | $W_{13/50}$ (W/kg) | $W_{14/50}$ (W/kg) | Noise level (dB) |
|---|---|---|---|---|---|---|---|---|---|---|
| 11 | $Fe_{81}Si_5B_{12.9}C_1Mn_{0.1}$ | 1.55 | 1.62 | 95.9 | 89 | 10.1 | 1.3 | 0.18 | 0.25 | 20 |
| 12 | $Fe_{81.95}Si_2B_{15.9}C_{0.05}Mn_{0.1}$ | 1.54 | 1.63 | 94.5 | 91 | 11.8 | 0.8 | 0.17 | 0.24 | 20 |
| 13 | $Fe_{82}Si_{0.1}B_{17.7}C_{0.1}Mn_{0.1}$ | 1.56 | 1.66 | 94.3 | 92 | 11.5 | 1.3 | 0.18 | 0.21 | 19 |
| 14 | $Fe_{82}Si_1B_{16.8}C_{0.1}Mn_{0.1}$ | 1.57 | 1.67 | 94.4 | 92 | 11.6 | 1.0 | 0.17 | 0.20 | 19 |
| 15 | $Fe_{82}Si_2B_{15.8}C_{0.1}Mn_{0.1}$ | 1.55 | 1.64 | 94.5 | 90 | 12.0 | 0.9 | 0.18 | 0.21 | 20 |
| 16 | $Fe_{82}Si_1B_{15.9}C_1Mn_{0.1}$ | 1.60 | 1.66 | 96.2 | 94 | 10.4 | 1.8 | 0.17 | 0.20 | 18 |
| 17 | $Fe_{82}Si_3B_{13.9}C_1Mn_{0.1}$ | 1.59 | 1.66 | 95.8 | 90 | 10.6 | 1.6 | 0.18 | 0.21 | 18 |
| 18 | $Fe_{82}Si_4B_{12.9}C_1Mn_{0.1}$ | 1.59 | 1.66 | 96.1 | 91 | 10.5 | 1.4 | 0.19 | 0.22 | 18 |
| 19 | $Fe_{82}Si_{0.1}B_{15.8}C_2Mn_{0.1}$ | 1.59 | 1.67 | 95.4 | 95 | 9.8 | 3.5 | 0.20 | 0.21 | 18 |
| 20 | $Fe_{82}Si_4B_{11.9}C_2Mn_{0.1}$ | 1.60 | 1.66 | 96.2 | 92 | 9.5 | 3.0 | 0.18 | 0.22 | 18 |
| 21 | $Fe_{83}Si_3B_{12.9}C_1Mn_{0.1}$ | 1.57 | 1.63 | 96.1 | 88 | 10.0 | 1.6 | 0.17 | 0.22 | 19 |
| 22 | $Fe_{83}Si_5B_{11.8}C_{0.1}Mn_{0.1}$ | 1.55 | 1.62 | 95.7 | 87 | 11.2 | 0.7 | 0.20 | 0.23 | 19 |
| 23 | $Fe_{80}Co_2Si_2B_{15.8}C_{0.1}Mn_{0.1}$ | 1.64 | 1.69 | 97.2 | 91 | 11.6 | 1.0 | 0.19 | 0.24 | 17 |
| 24 | $Fe_{72}Ni_9Si_5B_{13.8}C_{0.1}Mn_{0.1}$ | 1.54 | 1.60 | 96.3 | 91 | 11.5 | 0.8 | 0.21 | 0.27 | 20 |
| 25 | $Fe_{80}Ni_2Si_2B_{15.8}C_{0.1}Mn_{0.1}$ | 1.63 | 1.67 | 97.6 | 86 | 11.8 | 0.7 | 0.19 | 0.23 | 18 |
| 26 | $Fe_{82}Si_{0.8}B_{16.6}C_{0.5}Mn_{0.1}$ | 1.58 | 1.66 | 95.0 | 87 | 10.7 | 1.3 | 0.17 | 0.20 | 17 |
| 27 | $Fe_{82}Si_{0.8}B_{16.6}C_{0.5}Cr_{0.1}$ | 1.56 | 1.66 | 94.0 | 86 | 10.3 | 1.2 | 0.19 | 0.24 | 20 |
| 28 | $Fe_{82}Si_{0.8}B_{16.6}C_{0.5}Mo_{0.1}$ | 1.55 | 1.66 | 93.4 | 85 | 10.5 | 1.1 | 0.19 | 0.26 | 20 |
| 29 | $Fe_{82}Si_{0.8}B_{16.6}C_{0.5}Zr_{0.1}$ | 1.55 | 1.65 | 93.8 | 87 | 10.8 | 1.3 | 0.19 | 0.25 | 19 |
| 30 | $Fe_{82}Si_{0.8}B_{16.6}C_{0.5}Hf_{0.1}$ | 1.55 | 1.65 | 93.9 | 83 | 10.6 | 1.2 | 0.20 | 0.24 | 20 |

Example 2-2

Amorphous alloy ribbons having compositions shown in Table 4 was produced in a similar way to the case of Example 1, and the properties were measured on a toroidal magnetic core with an inner diameter/outer diameter of 25/35 mm. The properties are shown in Table 4. The addition of 4% of carbon increases a core loss of the amorphous alloy ribbon due to the increase of coercive force, and may cause a problem in a step of manufacturing the magnetic core because the amorphous alloy ribbon becomes brittle. The addition of 0.7 at % Mn decreases $B_s$, lowers squareness, increases the coercive force and increases the core loss. The addition of a large amount of both carbon and Mn increases a noise level as well.

TABLE 4

| | Sample | Composition (at %) | | | | | $B_{80}$ | Bs | $B_{80}$/Bs | Stress relaxation | $W_{13/50}$ | $W_{14/50}$ | Noise level |
|---|---|---|---|---|---|---|---|---|---|---|---|---|---|
| | No | Fe | Si | B | C | Mn | (T) | (T) | (T) | degree (%) | (W/kg) | (W/kg) | (dB) |
| Example 2-2 | 31 | 82.0 | 2.0 | 11.9 | 4.0 | 0.1 | 1.52 | 1.62 | 93.8 | 95 | 0.23 | 0.34 | 23 |
| Example 2-2 | 32 | 82.0 | 2.0 | 13.3 | 2.0 | 0.7 | 1.49 | 1.60 | 92.8 | 91 | 0.21 | 0.32 | 22 |

Referential Example 1

A toroidal magnetic core with an inner diameter/outer diameter of 25/35 mm was produced by using samples which were cast at gas pressures of 0 and 0.30 MPa in the vicinity of the roll surface at the exhaust nozzle, among amorphous alloy ribbons prepared in Example 1, and the properties were measured. The result is shown in Table 5. Sample No. 33 was a sample produced at a gas pressure of 0 MPa (20.5% oxygen by concentration), and sample No. 34 was a sample produced at a gas pressure of 0.3 MPa. Both samples had surface roughness on the rolled surface of 0.64 to 0.70 and 0.63 to 0.82 μm respectively. The samples had a peak position of a carbon segregation layer in the outside of the range, and showed all deteriorated values of squareness, a core loss and a noise level. FIGS. 4 and 5 show the analysis result of elements in a depth direction from the rolled surface of the samples 2 and 33.

TABLE 5

| | Sample No | $B_{80}$(T) | Bs(T) | $B_{80}$/Bs × 100(%) | Stress relaxation degree (%) | Peak position of carbon segregation layer (nm) | Value of carbon peak (at %) | $W_{13/50}$ (W/kg) | $W_{14/60}$ (W/kg) | Noise level (dB) |
|---|---|---|---|---|---|---|---|---|---|---|
| Example 1 | 2 | 1.60 | 1.67 | 95.9 | 95 | 10.1 | 3.2 | 0.15 | 0.21 | 17 |
| Referential Example 1 | 33 | 1.54 | 1.67 | 92.4 | 91 | 20.5 | 2.7 | 0.17 | 0.29 | 21 |
| Referential Example 1 | 34 | 1.53 | 1.67 | 91.8 | 88 | 21.5 | 2.1 | 0.17 | 0.33 | 21 |

Example 3

The above described toroidal magnetic core of Sample 2 and a magnetic core having an inner diameter/outer diameter of 90/120 mm were primarily and secondarily wound with a wire, and properties were measured. As a result, both samples showed that $B_{80}/B_s$ is improved by 3%, and a noise level is lowered by 3 to 5 dB. Thus, the magnetic cores were confirmed to be hopeful as magnetic cores of a transformer, a motor and an electric reactor.

INDUSTRIAL APPLICABILITY

The invention provides a magnetic core which has high squareness, a high magnetic flux density, a low noise level and a low core loss, by controlling heat treatment, surface roughness, an amount of carbon to be added and a ratio of a Si content to a carbon content. An applied product using the same is also provided. The magnetic core can be used as magnetic cores for a transformer, a motor and a choke coil.

Figure 1:
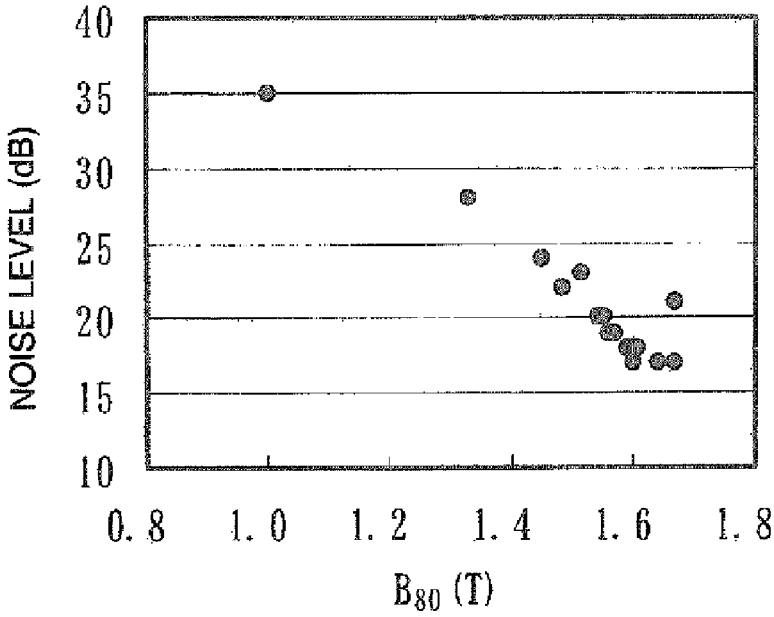
FIG. 1 is a view showing a relationship between a magnetic flux density $B_{80}$ in a magnetic core when an external magnetic field 80 A/m is applied thereto, and a noise level generated from the toroidal magnetic core having an average magnetic core diameter of 30 mm when a magnetic flux density is 1.4 T and a frequency of 50 Hz.
Figure 2:
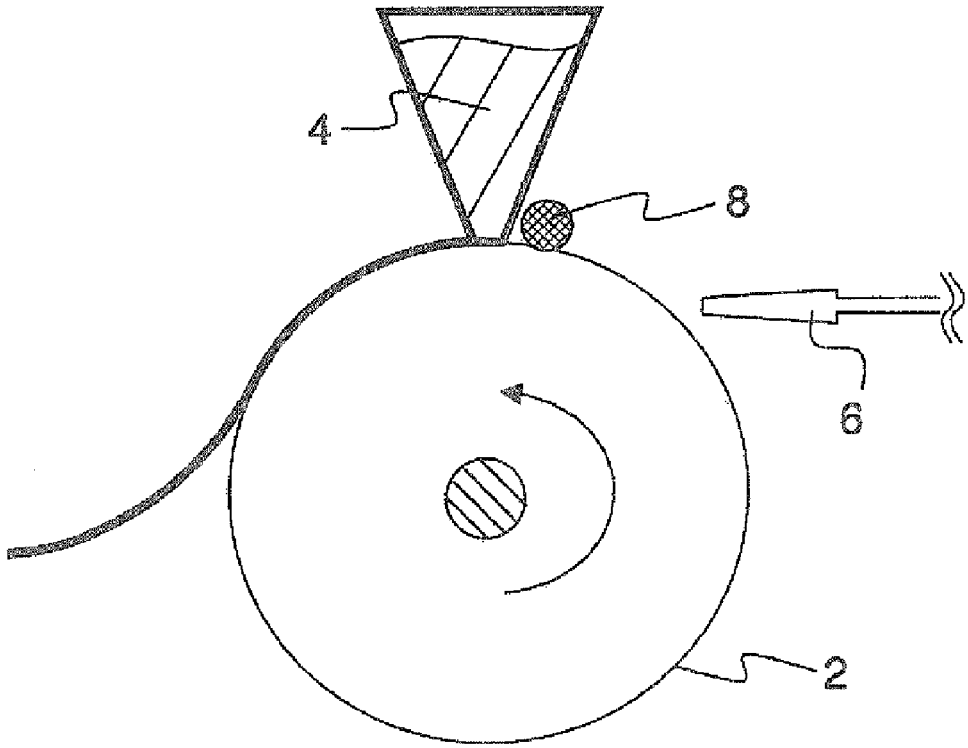
FIG. 2 is a schematic view of a position at which a gas is blown during a casting process, wherein reference numeral 2 denotes a roll, reference numeral 6 denotes a gas-blowing nozzle, reference numeral 4 denotes a molten metal, and reference numeral 8 denotes a measurement point for an oxygen concentration and a gas pressure.
Figure 3:
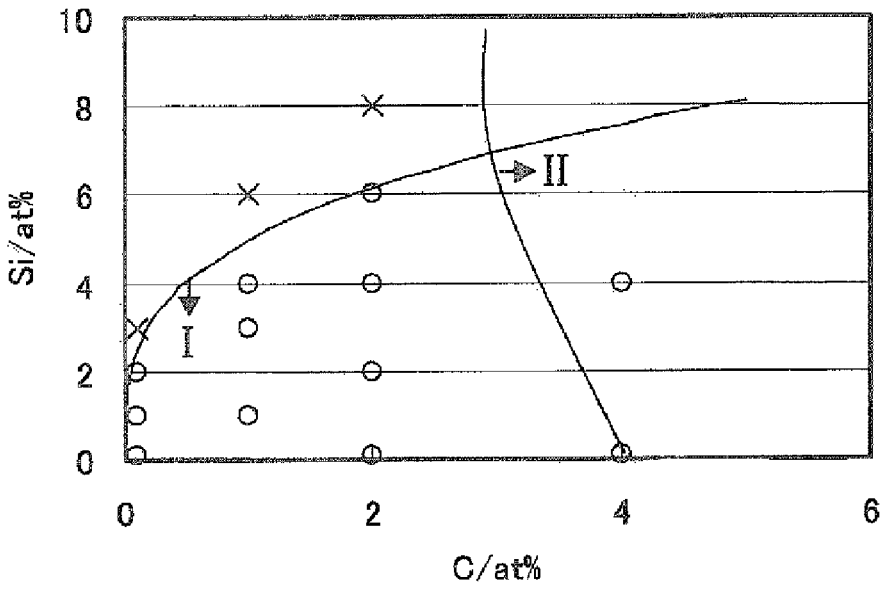
FIG. 3 is a view showing a relationship between a stress relaxation degree and a breaking strain when carbon and Si concentrations are varied in $Fe_{82}Si_xB_{18-x-y}C_y$, wherein a region "I" shows a composition region in which the stress relaxation degree becomes not less than 90%, and a region "II" shows a composition region in which the breaking strain becomes not more than 0.020.
Figure 4:
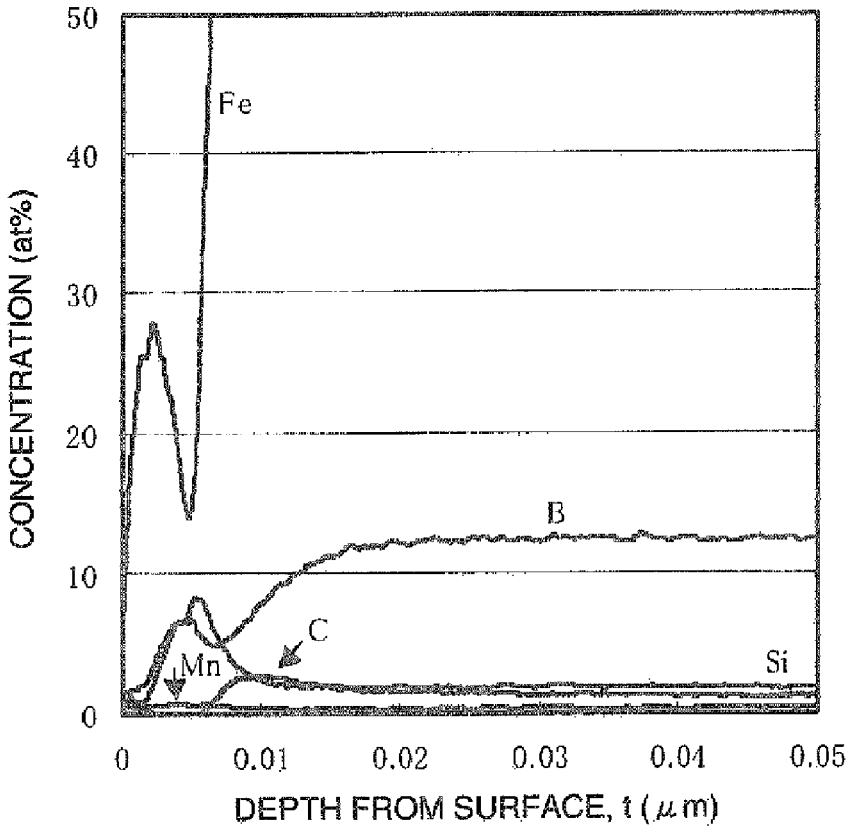
FIG. 4 shows a result of having analyzed the rolled surface of Sample 2.
Figure 5:
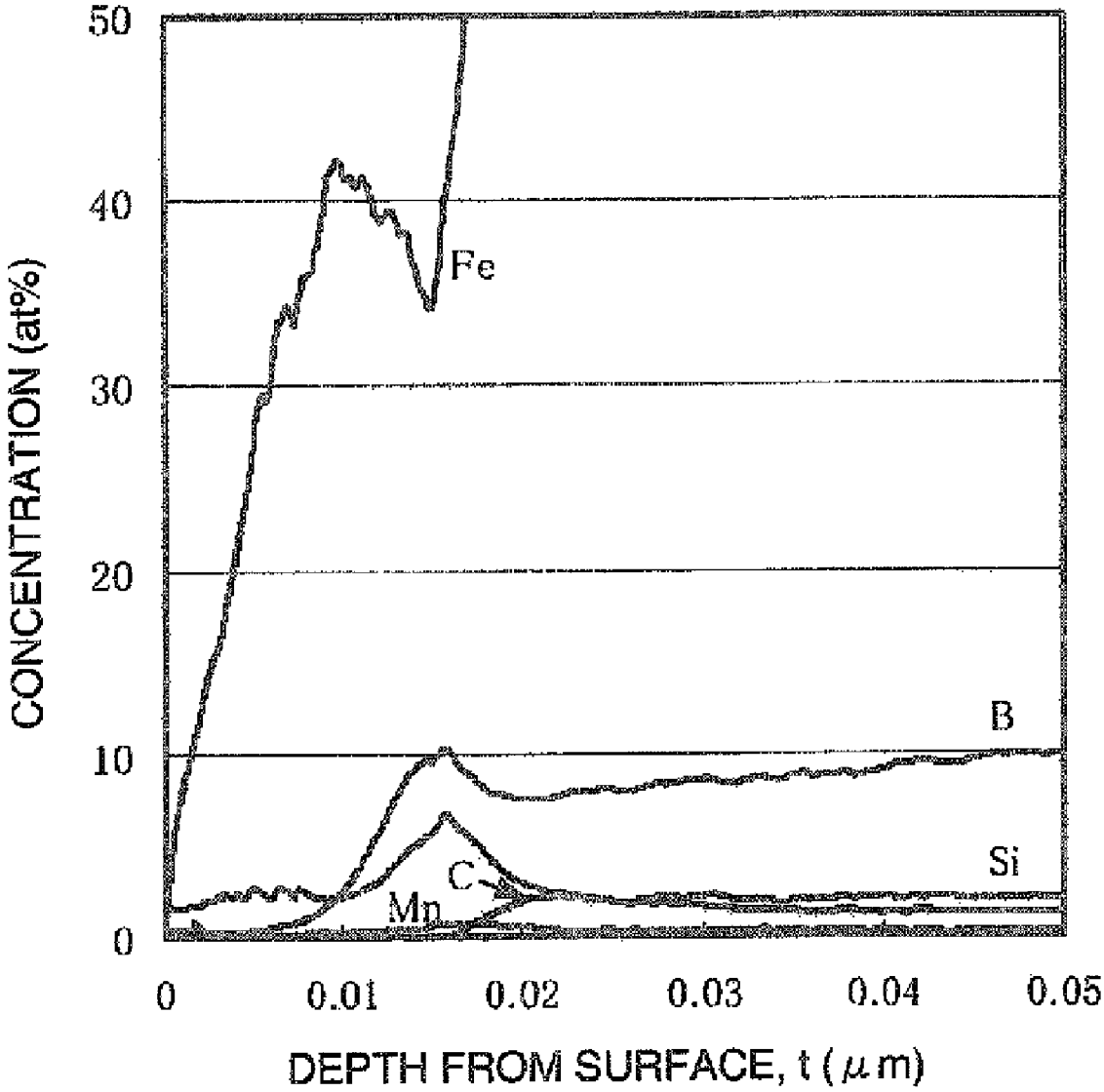
FIG. 5 shows a result of having analyzed the rolled surface of Sample 33.

The invention claimed is:

1. A magnetic core made of an Fe-based amorphous alloy ribbon, wherein the Fe-based amorphous alloy ribbon has a saturated magnetic flux density $B_s$ being not lower than 1.60 T, and a ratio $B_{80}/B_s$ being not less than 0.90, which is the ratio of a magnetic flux density $B_{80}$ generated when an external magnetic field of 80 A/m is applied to the magnetic core in relation to the saturated magnetic flux density $B_s$ of the Fe-based amorphous alloy ribbon, wherein the Fe-based amorphous alloy ribbon has a composition that is expressed by a formula $T_aSi_bB_cC_d$ wherein T represents Fe, or Fe and at least one element of Co and Ni in an amount of not more than 10% with respect to Fe, in which the suffixes satisfy the expressions of, by atomic percent, $81 \leqq a \leqq 83\%$, $0 < b \leqq 5\%$, $10 \leqq c \leqq 18\%$, and $0.2 \leqq d \leqq 3\%$, and that includes unavoidable impurities; and wherein the Fe-based amorphous alloy ribbon has a carbon segregation layer having a peak position in a range between 2 nm and 20 nm deep from a ribbon surface.

2. The magnetic core according to claim 1, wherein a core loss $W_{14/50}$ is not higher than 0.28 W/kg when a magnetic flux density is 1.4 T and a frequency is 50 Hz.

3. The magnetic core according to claim 1 or 2, wherein a noise level is $20 \times \log [L^2 \times 10^{-9} + 2 \times 10^{-5})/(2 \times 10^{-6})]$ dB or less when a magnetic flux density is 1.4 T, a frequency is 50 Hz and an average magnetic path length is L mm.

4. The magnetic core according to claim 1, wherein the Fe-based amorphous alloy ribbon shows a ratio $B_{80}/B_s$ of not less than 0.93, which is the ratio of a magnetic flux density $B_{80}$ generated when an external magnetic field of 80 A/m is applied to the magnetic core in relation to a saturated magnetic flux density $B_s$ of the Fe-based amorphous alloy ribbon.

5. The magnetic core according to claim 1, wherein the ribbon has a surface roughness of not more than 0.60 μm.

6. The magnetic core according to claim 1 or 5, wherein the Fe-based amorphous alloy ribbon shows a ratio $B_{80}/B_s$ being not less than 0.95, which is the ratio of a magnetic flux density $B_{80}$ generated when an external magnetic field of 80 A/m is applied to the magnetic core in relation to the saturated magnetic flux density $B_s$ of the Fe-based amorphous alloy ribbon.

7. An applied product including the magnetic core according to any one of claims 1, 2, 4 or 5, wherein the applied product is a motor, a transformer, a choke coil, a generator or a sensor.

8. An applied product including the magnetic core according to claim 3, wherein the applied product is a motor, a transformer, a choke coil, a generator or a sensor.

9. An applied product including the magnetic core according to claim 6, wherein the applied product is a motor, a transformer, a choke coil, a generator or a sensor.

* * * * *